US006051768A

United States Patent [19]

Masubuchi

[11] Patent Number: 6,051,768

[45] Date of Patent: Apr. 18, 2000

[54] KEYBOARD ASSEMBLY

[75] Inventor: Takamichi Masubuchi, Hamamatsu, Japan

[73] Assignee: Yamaha Corporation, Hamamatsu, Japan

[21] Appl. No.: 09/073,144

[22] Filed: May 4, 1998

[30] Foreign Application Priority Data

Jun. 6, 1997 [JP] Japan ..... 9-163531

[51] Int. Cl.[7] ..... G10C 3/12

[52] U.S. Cl. ..... 84/433; 84/423 R; 84/430

[58] Field of Search ..... 84/174, 719, 430, 84/432, 433, 435, 436, 447, 448, 423 R

[56] References Cited

U.S. PATENT DOCUMENTS

| | | | |
|---|---|---|---|
| 3,205,754 | 9/1965 | Becwar | 84/433 |
| 3,570,359 | 3/1971 | Ohno | 84/423 |
| 3,663,738 | 5/1972 | Nakada | 84/423 |
| 3,750,522 | 8/1973 | Groves et al. | 84/423 |
| 3,855,894 | 12/1974 | Thomas et al. | 84/423 |
| 3,941,023 | 3/1976 | Thomas et al. | 84/1.01 |
| 4,091,707 | 5/1978 | Martin et al. | 84/423 |
| 4,240,321 | 12/1980 | Goldenberg | 84/433 |
| 4,351,222 | 9/1982 | Kumano | 84/423 R |
| 4,434,340 | 2/1984 | Kondo | 200/332 |
| 4,488,472 | 12/1984 | Kumano et al. | 84/434 |
| 5,081,895 | 1/1992 | Katsuta | 84/433 |
| 5,610,352 | 3/1997 | Yamaguchi | 84/435 |
| 5,847,301 | 12/1998 | Steinbuhler | 84/433 |

FOREIGN PATENT DOCUMENTS

| | | |
|---|---|---|
| 54-5713 | 1/1979 | Japan . |
| 3-174192 | 7/1991 | Japan . |
| 6-175648 | 6/1994 | Japan . |
| 7-092963 | 4/1995 | Japan . |

*Primary Examiner*—Robert E. Nappi
*Assistant Examiner*—Shih-yung Hsieh
*Attorney, Agent, or Firm*—Graham & James LLP

[57] ABSTRACT

A keyboard assembly includes a plurality of white keys and black keys juxtaposed to each other and each having a body disposed to be depressed, and a connecting portion, and a key support that supports the body. The connecting portion connects the body to the key support in a fashion permitting the body to swing in directions of key depression and release while limiting lateral motions of the body. The body of each of the white keys has an extension formed integrally therewith and laterally extending therefrom at a location under the body of a corresponding one of the black keys in such a manner that the extension overlaps with the bottom surface of the body of the corresponding one of the black keys.

9 Claims, 4 Drawing Sheets

KEYBOARD ASSEMBLY

BACKGROUND OF THE INVENTION

1. Field of the Invention

This invention relates to a keyboard assembly for use in an electronic organ and the like.

2. Prior Art

In general, a conventional keyboard assembly having white keys and black keys juxtaposed to each other is constructed such that white key units and black key units are each formed of bodies of white or black keys connected to a key support member via respective connecting portions (hinges) in a manner being swingable in directions of key depression and release, with a white key unit and a black key unit of each pair being laminated one upon the other at the key support member and being fixed to a main frame or the like. Further, except for a miniature type keyboard assembly having short key bodies, the keyboard assembly has a key guide provided in the vicinity of a front end (free end) of each key to increase the flexural rigidity of the key for limiting motions of the key body in lateral directions in which the keys are juxtaposed (lateral motions) to thereby limit lateral motions of keys and hence facilite and improve the performance of glissando etc.

The provision of the key guide, however, complicates the construction of the keyboard assembly and is hence disadvantageous in respect of the manufacturing cost. Further, it requires applying grease to portions of the body of each key in sliding contact with the key guide for prevention of mechanical noise. This is not only troublesome but also undesirable from the view point of the quality of performance played by the keyboard assembly since the mechanical noise is generated when the grease becomes short. Further, when a foreign substance, such as dust, is caught between the body of a key and the key guide, this impedes smooth key-depressing operation.

To solve the above-mentioned problems, a key board assembly has been proposed by Japanese Laid-Open Patent Publication (Kokai) No. 7-92963, in which the connecting portion of each key is made larger in lateral width than a rear end portion of the key body and at the same time disposed to partially overlap with the connecting portions of adjacent keys. This can fully limit lateral motions of keys even without the use of the key guide.

The proposed keyboard assembly which thus does not employ the key guide, however, requires increasing the lateral width of the connecting portion of each key to such a degree that the connecting portion becomes much wider than the width of the key body so as to increase the flexural rigidity of the key in the lateral directions. In other words, to avoid interference between adjacent connecting portions, it is required to group white keys into a plurality of divisional units (e.g. upper and lower units) even over a range of one octave of musical tones. This makes it impossible to form the white keys into a single unit in which they are arranged in the order of pitch and connected to the key support. As a result, the construction of the keyboard assembly is complicated, and it is troublesome to adjust the divisional units for alignment, which results in an increased manufacturing cost.

SUMMARY OF THE INVENTION

It is an object of the invention to provide a keyboard assembly which is capable of properly limiting lateral motions of each white key without the use of a key guide, facilitates adjustment of key units for alignment, and can be manufactured at a reduced cost.

To attain the object, the present invention provides a keyboard assembly including a plurality of white keys and black keys juxtaposed to each other, the white keys and the black keys each having a body disposed to be depressed, and a connecting portion, and key support means that supports the body, the body of each of the black keys having a bottom surface, the connecting portion connecting the body to said key support means in a fashion permitting the body to swing in directions of key depression and release while limiting lateral motions of the body.

The keyboard assembly according to the present invention is characterized in that the body of each of the white keys has an extension formed integrally therewith and laterally extending therefrom at a location under the body of a corresponding one of the black keys in a manner such that the extension overlaps with the bottom surface of the body of the corresponding one of the black keys.

Preferably, the connecting portion of the each of the white keys is substantially equal in width in a direction of juxtaposition of the white keys and the black keys to a portion of the body of the each of the white keys formed with the extension, the white keys having respective ones of the body arranged in an order of pitch and integrally connected to the key support means via respective ones of the connecting portion.

Preferably, the white keys are grouped into at least one group, the white keys of each of the at least one group being integrally connected to the key support means to form a single key unit.

Preferably, the extension is disposed in a manner such that the bottom surface of the body of the corresponding one of the black keys becomes almost parallel with the extension when the corresponding one of the black keys is depressed.

More preferably, the extension is formed in a inclined fashion with respect to the body of the each of the white keys.

More preferably, the single key unit includes a C key, a D key and an E key.

More preferably, the white keys of the each of the at least one group forming the single key unit include white keys located outward relative to at least one other white key forming the single key unit, each of the white keys located outward having the extension located inward relative to the body of the each of the white keys located outward.

Preferably, the extension and the connecting portion are formed integrally with each other.

More preferably, a total width of the portion of the body of the each of the white keys formed with the extension in the direction of juxtaposition of the white keys and the black keys is substantially equal to a maximum width of the body of the each of the white keys in the direction of juxtaposition of the white keys and the black keys.

The above and other objects of the invention will become more apparent from the following detailed description taken in conjunction with the accompanying drawings.

BRIEF DESCRIPTION OF THE DRAWINGS

FIGS. 4A to 4D are views useful in comparing between a white key unit according to the prior art and one according to the embodiment, in which:

FIG. 4A is a top plan view of the white key unit according to the prior art;

FIG. 4B is a cross-sectional view of the same taken on line X1—X1 in FIG. 4A;

FIG. 4C is a top plan view of the white key unit according to the embodiment; and FIG. 4D is a cross-sectional view of the same taken on line X2—X2 in FIG. 4C.

DETAILED DESCRIPTION

Next, the invention will now be described in detail with reference to drawings showing a preferred embodiment thereof.

Figure 1:
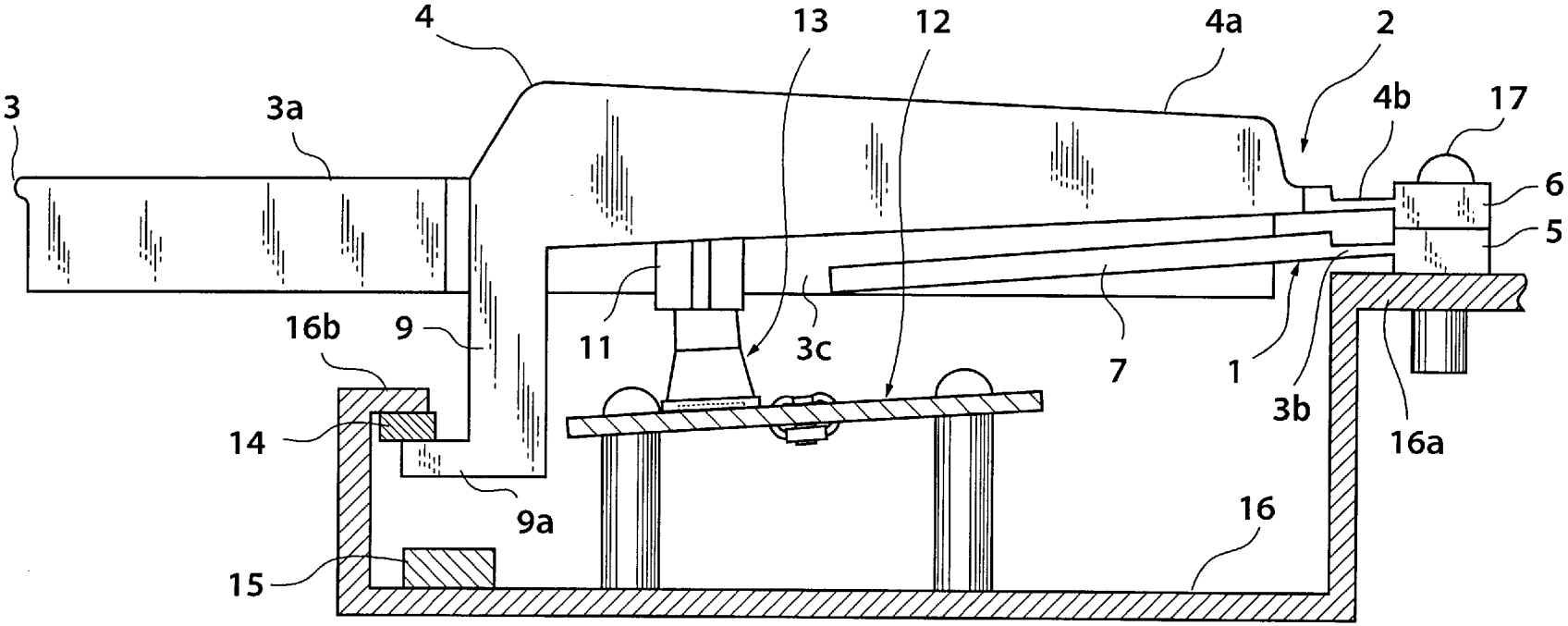
FIG. 1 is a partial vertical longitudinal sectional view showing the construction of a keyboard assembly according to an embodiment of the invention.

Referring first to FIG. 1, there is shown in vertical longitudinal section part of a keyboard assembly according to an embodiment of the invention. In the figure, reference numeral 1 designates a white key unit 1 which is constructed such that each white key 3 has a body 3*a* thereof connected to a white key support 5 via a white key connecting portion 3*b* in a manner being swingable in directions of key depression and release (vertical directions as viewed in the figure) when the white key 3 is depressed. Similarly, a black key unit 2 is constructed such that each black key 4 has a body 4*a* thereof connected to a black key support 6 via a black key connecting portion 4*b* in a manner being swingable in the directions of key depression and release when the black key 4 is depressed. The key units 1 and 2 each correspond to one octave of musical tones.

The white key unit 1 and the black key unit 2 are mounted on a lower case 16, and an upper case, not shown, and the lower case 16 are joined to each other at their rear ends and opposite lateral sides. The key units 1, 2 are mounted on the lower case 16 with their connecting portions 3*b*, 4*b* connected respectively to the white key support 5 and the black key support 6 which are laminated one upon the other and at the same time fixed to a rear end 16*a* of the lower case 16 by screws 17.

Figure 2A:
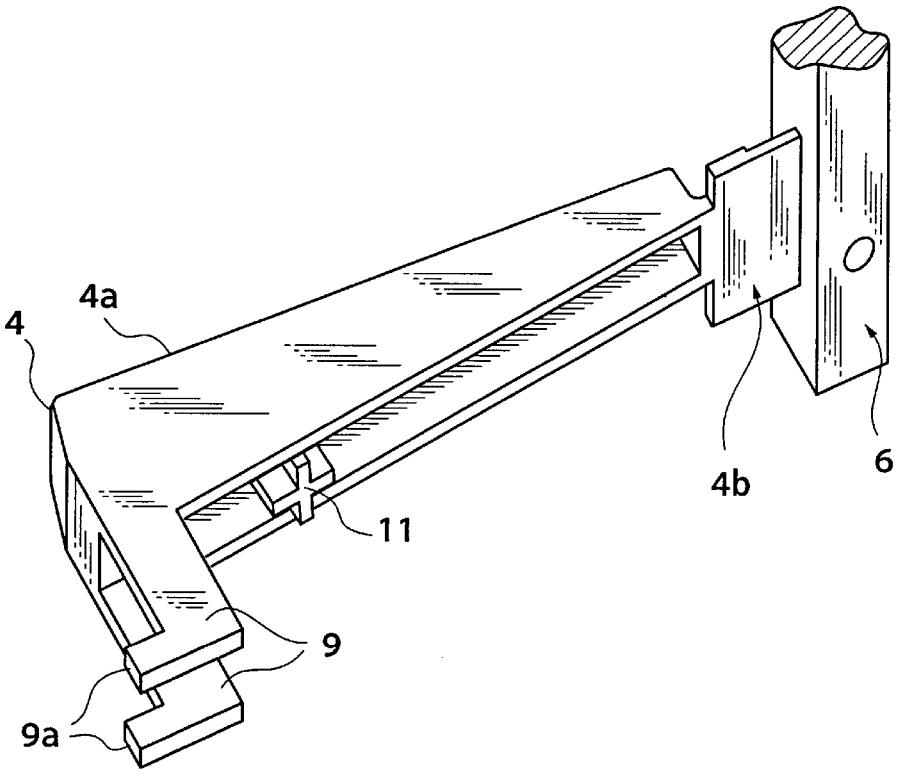
FIG. 2A is a perspective view of a black key of the keyboard assembly as viewed diagonally from below.
Figure 2B:
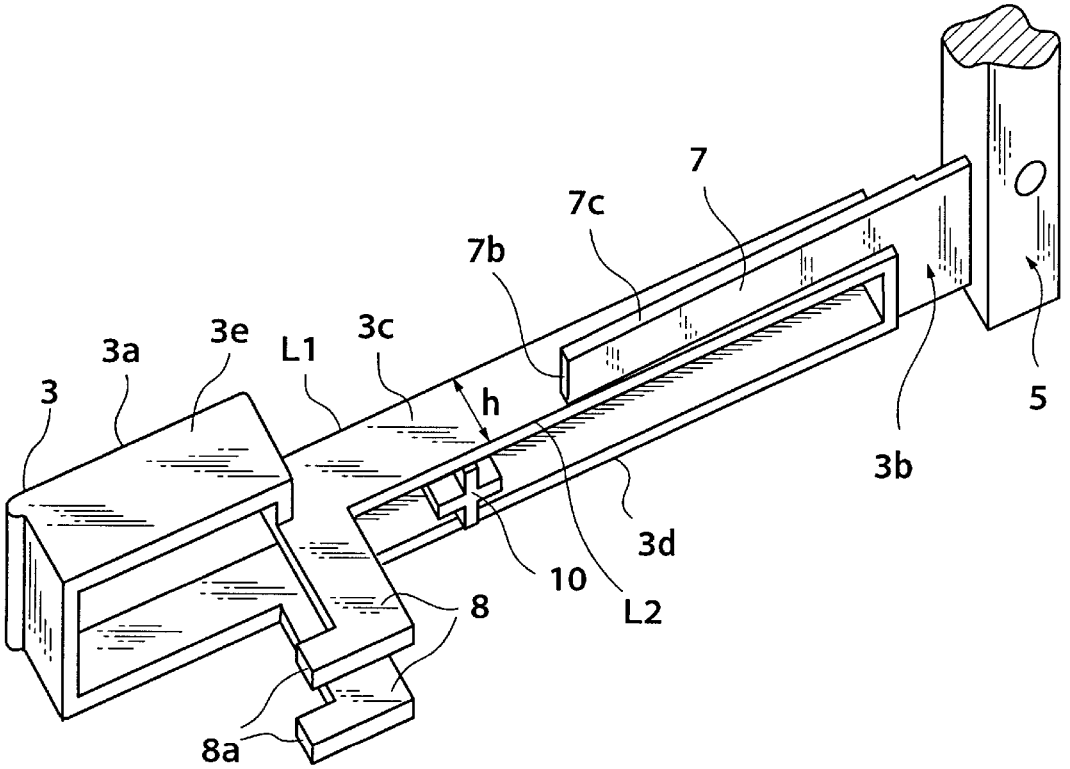
FIG. 2B is a perspective view of a white key (C key) of the keyboard assembly as viewed diagonally from below.

FIGS. 2A and 2B show the black key 4 and the white key (C key) 3, respectively, as viewed diagonally from below.

The white key 3 and the black key 4 are provided with a white key actuator 10 (not shown in FIG. 1), and a black key actuator 11, respectively. The white key actuator 10 is formed integrally or in one body with the white key 3, and the black key actuator 11 is formed integrally with the black key 4. A bottom portion of the black key actuator 11 protrudes downward from bottom surfaces of side walls of the black key 4. When the keys are not depressed, the key actuators 10, 11 have bottom surfaces thereof almost flush with each other.

As shown in FIG. 1, a switch circuit board 12 is provided at an upper location within the lower case 16. Key switches 13 are arranged on the switch circuit board 12 at respective locations corresponding to the keys. When each key is depressed, an upper end of the corresponding key switch 13 is depressed by the white key actuator 10 or the black key actuator 11, whereby the depression of the key is detected.

A white key pendent portion 8 is formed integrally on the body 3*a* of the white key 3 in a fashion depending from a lower edge thereof (see FIG. 2B). A black key pendent portion 4*a* is formed integrally on the body 4*a* of the black key 4 in a fashion depending from a lower edge thereof (see FIG. 2A). The pendent portions 8, 9 have respective integral engaging ends 8*a*, 9*a* extending forward (toward the player side).

As shown in FIG. 1, the lower case 16 has a depressed key stopper 15 provided therein, which extends in a lateral direction in which the keys are juxtaposed along the total width of the keys. Further, an upper limit stopper 14 is provided at an underside of a front end portion 16*b* of the lower case 16, which also extends in the lateral direction along the total width of the keys.

Each of the engaging portions 8*a*, 9*a* of the white and black keys 3, 4 abuts the upper limit stopper 14 when the corresponding key is not depressed, and is brought into abutment with the depressed key stopper 15 when the corresponding key is depressed.

Figure 3A:
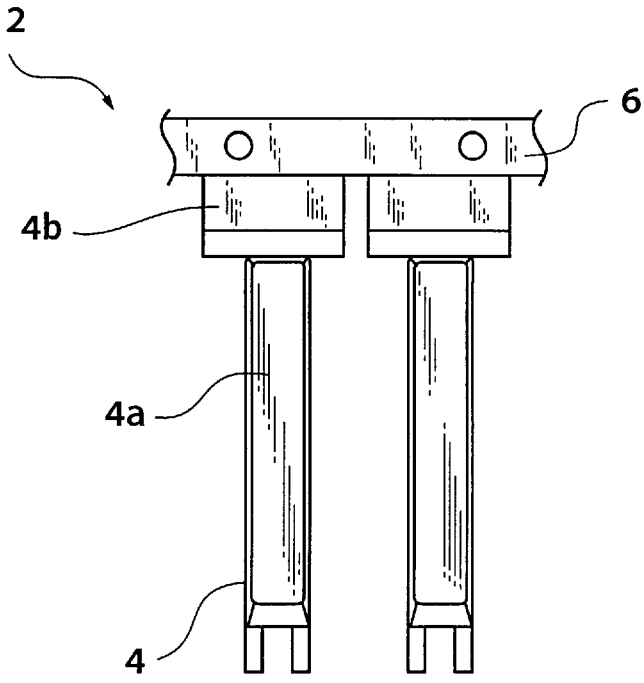
FIG. 3A is a top plan view of part of a black key unit of the keyboard assembly.
Figure 3B:
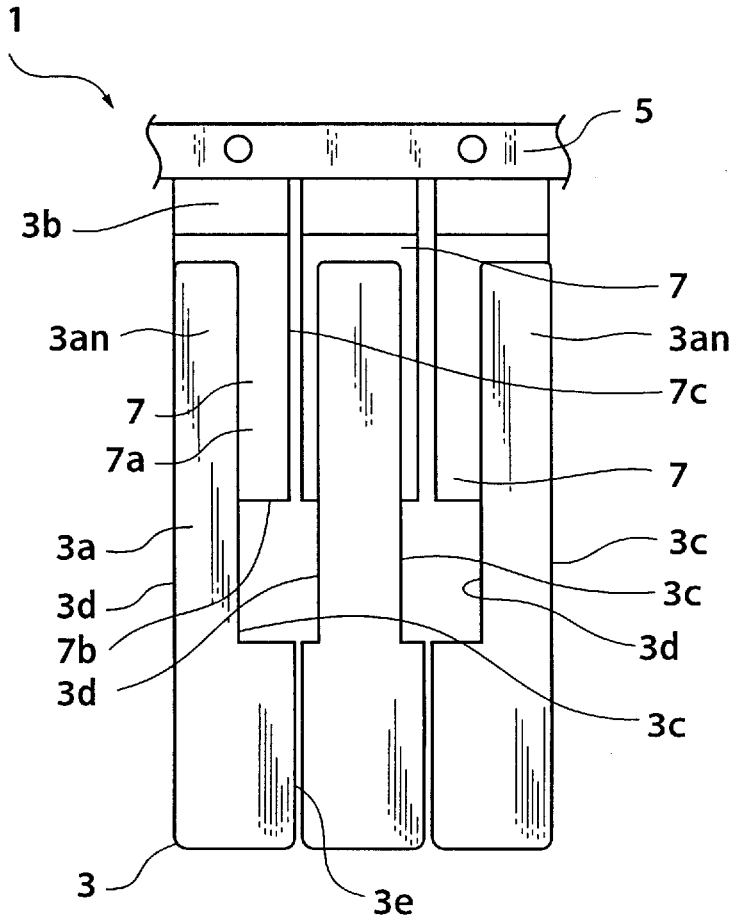
FIG. 3B is a top plan view of part of a white key unit laminated under the part of the black key unit shown in FIG. 3A.

FIGS. 3A and 3B show part of the black key unit 2 and part of the white key unit 1 laminated thereunder, in respective top plan views.

The black key 4 has a connecting portion 4*b* which is of a broad-width type similar to that of the conventional key board unit proposed by Japanese Laid-Open Patent Publication (Kokai) No. 7-92963. Store specifically, as shown in FIG. 3A, the connecting portion 4*b* has a larger lateral width than that of the key body 4*a*, whereby sufficient flexural rigidity of the black key 4 required for limiting lateral motions of the black key 4 is secured without the use of a key guide.

The white key 3 has a rear end portion 3*an* thereof formed integrally with an extension 7. If the white key 3 is a C key (the left one in FIG. 3B), the extension 7 extends only from a right-side surface 3*c* of the rear end portion 3*an* of the body 3*a* of the white key 3, but does not extend from a left-side surface 3*d* of the same as shown in FIGS. 2B and 3B. The extension 7 is in the form of an elongate rectangular plate and disposed such that the extension 7 overlaps with bottom surfaces of the body 4*a* of the corresponding black key 4 when the white key unit 1 and the black key unit 2 are laminated one upon the other.

In the illustrated embodiment, the extension 7 has such a size that the combined or total lateral width of the extension 7 and the rear end portion 3*an* of the white key 3 (width from the left-side surface 3*d* of the body 3*a* to a right-side surface 7*c* of the extension 7) is substantially equal to the maximum lateral width of the body 3*a* of the white key. For instance, the right-side surface 7*c* of the extension 7 is almost flush with a right-side surface 3*e* of a front end of the white key 3. This imparts a uniform and sufficient degree of flexural rigidity in the lateral directions to each white key 3, as described hereinafter. Alternatively, the total lateral width of the extension 7 and the rear end portion 3*an* may be set to a width slightly smaller than the maximum lateral width of the body 3*a* of the white key 3. Further, the extension 7 has a rear end thereof formed integrally with the connecting portion 3*b* of the white key 3, and the lateral width of the connecting portion 3*b* is substantially equal to the total lateral width of the rear end portion 3*an* and the extension 7. This is advantageous in respect of the rigidity of the white keys and productivity, and further the extension 7 and the connecting portion 3*b* do not interfere with corresponding portions of an adjacent white key or keys 3. As a result, in the keyboard assembly of the present embodiment, the bodies 3*a* of white keys 3 can be arranged in the order of pitch and connected to the white key support 5 via the respective connecting portions 3*b*, to provide the white key unit 1 which is not divided into a plurality of divisional units but formed as a single unit even over a range of one octave of musical tones.

Further, the extension 7 is configurated and disposed within such an extent that it does not interfere with the depressing operation of the black key 4. For instance, the extension 7 has a length or longitudinal size thereof set to such a value that it does not interfere with the black key actuator 11 when the black key 4 is depressed. More specifically, to avoid the configuration of the extension 7 (particularly, the length or longitudinal size and the thickness or vertical size) from impeding depressing operation of the adjacent black key 4, the extension 7 is configurated and disposed such that a front end (player side end) of the extension 7 is located well rearward of a position of the actuator 11 of the adjacent black key 4 assumed when the key 4 is depressed, and a top surface 7*a* of the extension 7 is located well downward of a position of the bottom of the body 4*a* of the black key 4 assumed when the key 4 is depressed. That is, the vertical location of the extension 7 is set such that the top surface 7*a* of the extension 7 is not brought into abutment with the bottom surface of the corresponding side wall of the body 4*a* of the black key 4 when the black key 4 is depressed.

Further, as shown in FIGS. 1 and 2B, the extension 7 is inclined relative to the key body 3*a* such that it progressively rises toward the connecting portion 3*b*. The degree of inclination is set such that the bottom surfaces of the side walls of the body 4*a* of the black key 4 become almost parallel with the extension 7 when the black key 4 is depressed. The inclination of the extension 7 increases the rigidity of the rear end portion 3*an* of the white key 3 in the vertical directions.

The white keys 3 other than the C key each have an extension 7 formed thereon in a manner extending from one or both of the right-side and left-side surfaces 3*c*, 3*d* thereof. For instance, the extension 7 of a D key (central key in FIG. 3B) extends from the right-side and left-side surfaces 3*c* and 3*d* of the D key, while the extension 7 of an E key (right key in FIG. 3B) extends only from the left-side surface 3*d* of the E key. It should be noted that for each key, the total lateral width of a portion of the key body 3*a* formed with the extension 7 and the extension 7 is set similarly to that of the C key described above.

Figure 4A:
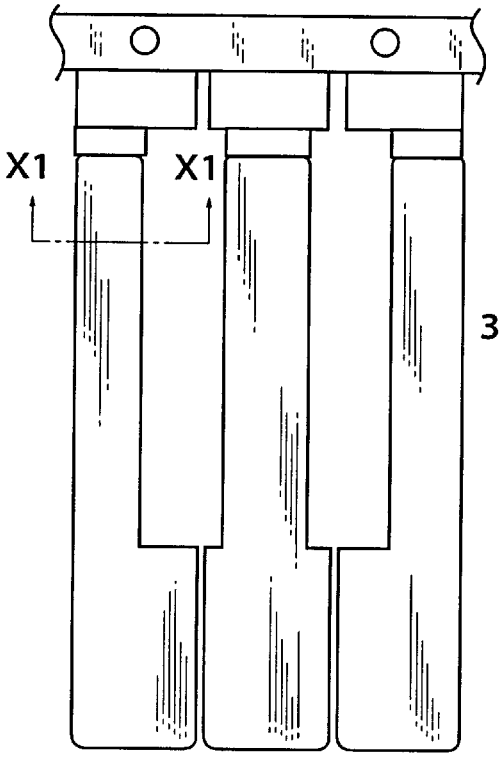
Figure 4C:
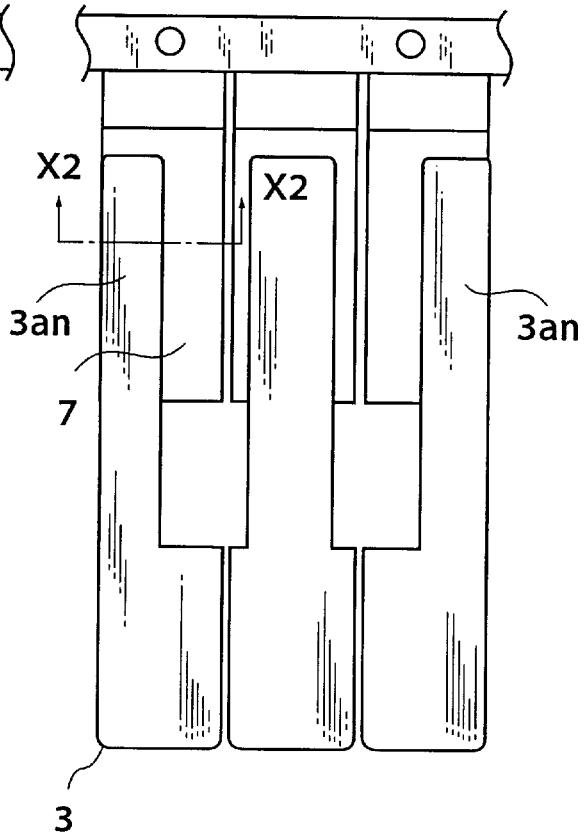
Figure 4B:
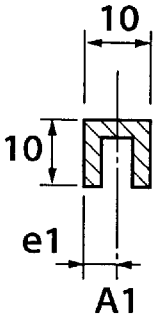
Figure 4D:
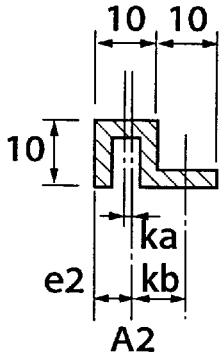

FIGS. 4A to 4D are views showing the white key units and the cross sections thereof according to the prior art and the present embodiment, for comparison. FIG. 4A is a top plan view of part of the conventional white key unit (which does not employ a connecting portion of the broad width type), and FIG. 4B is a cross-sectional view of a rear portion of the white key (take on line X1—X1 in FIG. 4A). FIG. 4C is a top plan view of part of the white key unit 1 of the present embodiment (similar to FIG. 3B), and FIG. 4D is a cross-sectional view of a rear portion of the white key 3 (take on line X2—X2 in FIG. 4C).

In general, the resistance to bending of a beam is expressed by a flexural rigidity EI wherein E represents Young's modulus dependent on the material of the beam, and I represents geometrical moment of inertia determined by the shape of the cross section. For instance, the deflection amount (or amount of bend) δ of a cantilever having a length L obtained when an external force W acts on the free end of the cantilever is expressed by the following formula (1):

$$\delta = WL^3/3EI \tag{1}$$

Thus, the deflection amount δ is inversely proportional to the geometrical moment of inertia I, and the flexural rigidity E is determined by the material. Therefore, so long as the cantilever remains the same in material, length, and in cross section, the deflection amount δ caused by the same external force is a function of the geometrical moment of inertia I alone (as the I value is larger, the cantilever is more resistant to bending).

The white key 3 can be regarded as a kind of cantilever the body 3*a* of which is supported at an end thereof on the support member 5 by the connecting portion 3*b*. Further, to maintain sufficient resistance to bending of each key in the lateral directions against an external force laterally applied to the key during performance of glissando or the like, it matters how to increase the geometrical moment of inertia with respect to a neutral axis in the vertical direction.

In the conventional white key, the geometrical moment of inertia I1 with respect to a neutral axis A1 shown in FIG. 4B can be obtained by the following formula (2) in which it is assumed that the thickness of the white key is "2 mm", the width and height of the X1—X1 cross section of the rear portion of the white key 3 are both "10 mm", with the distance e1 from the left-side surface of the white key to the neutral axis A1 being "5 mm":

$$I1=(10\times103)/12-(8\times63)/12=689.3 \tag{2}$$

In the white key 3 of the present embodiment, a geometrical moment of inertia I2 with respect to a neutral axis A2 shown in FIG. 4D can be obtained by the following formula (3) in which it is assumed that the thickness of the white key is "2 mm", the width of the X2—X2 cross section of the rear portion of the white key 3 including the extension 7 is "20 mm", and the height of the same is "10 mm". For the convenience of calculation, let it be assumed that the cross section of the key body 3*a* is divided into a portion (having a shape of inverted U) other than that of the extension 7 and a portion (having a shape of I) of the extension 7 alone, and then it is possible to calculate from the moment of area the distance Ka between a neutral axis of the portion having the shape of inverted U and the neutral axis A2 to be "2.8 mm", the distance Kb between a neutral axis of the portion having the shape of I and the neutral axis A2 to be "7.2 mm", and the distance e2 between the left-side surface of the white key 3 and the neutral axis A2 to be "7.8 mm":

$$\begin{aligned} I2 &= 689.3 + (2.82\times52) + ((2\times103)/12) + (7.22\times2\times10) \\ &= 2300.4 \end{aligned} \tag{3}$$

Therefore, the portion of the white key 3 provided with the extension 7 can be increased in flexural rigidity to approximately three times as large as that of the prior art, thereby increasing the resistance to bending of the white key 3 against an external force laterally applied thereto.

Also in the case of the D key (central key in FIG. 4C) in which the extension 7 extends from the opposite side surfaces 3*c* and 3*d* of the white key 3, and in the case of the E key (right key in FIG. 4C) in which the extension 7 extends only from the left-side surface 3*d* of the white key 3, the flexural rigidity of the white key 3 is increased to approximately three times as large as that of the prior art.

According to the present embodiment, the extension 7 is formed in a fashion laterally extending from the body 3*a* of each white key 3 at a location under the body 4*a* of each corresponding black key 4. Therefore, the geometrical moment of inertia I2 of the portion of each white key 3 provided with the extension 7 can be increased to thereby increase the flexural rigidity of the white key 3. As a result, the deflection amount of the body 3*a* of each white key caused by an external force laterally applied thereto is reduced whereby lateral motions of the white key can be properly limited without the use of a key guide. This provides an advantageous effect of facilitating performance of glissando and the like. Further, it is possible to eliminate inconveniences resulting from the provision of the key guide, such as complicated construction, an increase in the manufacturing cost, generation of mechanical noise, and trouble of applying grease to the key guide.

Furthermore, since the outermost white keys have the extensions thereof located inward relative to the key body, it is easy to arrange a plurality of key units in juxtaposition by connecting one key unit to another.

Further, the extension 7 is formed to have such a lateral width that the total width of the portion of the body 3*a* of the white key 3 formed with the extension 7 and the extension 7 is not larger than a width substantially equal to the maximum lateral width of the body 3*a*. Therefore, each white key 3 can have uniform and sufficient flexural rigidity in the lateral directions, whereby lateral motions of each white key 3 can be more effectively limited. Further, the extension 7 is formed integrally with the connecting portion 3*b* of the white key 3, and at the same the width thereof is made substantially equal to the width of the connecting portion 3*b* of the same. This makes it easier to fabricate a metal mold for the white keys 3, thereby being advantageous in respect of the productivity and rigidity of the white keys 3. Furthermore, since the extension 7 provides a sufficient amount of geometrical moment of inertia I2 for the white key 3, the connecting portion 3*b* need not be of the broad width type.

Since the connecting portion 3*b* is thus not of the broad width type, an advantageous supporting structure of the white keys 3 can be obtained in that it is easier to construct the white key unit 1 as a single unit without dividing the same into divisional units even over a range corresponding to one octave of musical tones. However, the construction of the white key unit 1 as a single unit requires consideration on solutions to a problem encountered in fabricating the metal mold. That is, since the spaces between adjacent white keys 3 are very small, there arises a problem of how rib walls of the metal mold should be formed to mold the white key unit 1 in a single unit.

For instance, the problem is how to form opposed side walls e.g. of the E key and an F key, or those of a B key and the C key when the F and E keys are formed into a single unit. It is preferred that the height h of the side walls (see FIG. 2B) should be as small as possible for the durability or life of the metal mold. However, to increase the rigidity of the keys 3, 4 in the vertical directions, it is preferable to set the height h as large as possible. If the thickness of each side wall is increased, the required rigidity of the keys 3, 4 can be secured, but this solution is disadvantageous not only because a larger amount of resin material is required but also because a so-called "molding sink" is likely to be formed at portions of the keys which are discontinuous in thickness.

However, in the present embodiment, the extension 7 extends diagonally with respect to the upper and lower sides L1, L2 of the side walls (FIG. 2B) such that the extension 7 becomes parallel with the bottom surfaces of the side walls of the black key 4 when the black key 4 is depressed. Therefore, the extension 7 plays the role of so-called "brace" as employed in a building and the like.

This makes it possible to secure the required rigidity of the keys 3 and 4 in the vertical (directions of key depression and release) even if the height h is set to a small value, and hence the rib walls of the metal mold can be made smaller in height. As a result, the metal mold can have an increased durability sufficient for withstanding mass production, and an increased number of white keys (e.g. corresponding to one octave or several octaves of musical tones) can be formed into a single unit. Therefore, compared with the case of dividing the white key unit 1 into several divisional units, the trouble of adjusting these parts for alignment can be saved, and a simplified construction of the keyboard assembly and hence a reduced manufacturing cost can be realized.

Further, after the white key unit 1 and the black key unit 2 are mounted on the lower case 16, internal parts within the lower case 16 are hardly visible through gaps between the white keys 3 and the black keys 4, resulting in an improved appearance of the keyboard assembly. Further, foreign substances, such as clips, are unlikely to drop into the interior of the keyboard assembly through the gaps, which minimizes the possibility of malfunctioning of the keyboard assembly.

Although in the illustrated embodiment, the connecting portion 3*b* has a larger width than that of the rear end potion 3*an* of the body 3*a* of the white key 3 to limit lateral motions of the body 3*a,* this is not limitative, but the connecting portion 3*b* may have a width almost equal to the width of the rear end portion 3*an* of the body 3*a*. In such a case, to limit lateral motions of the body 3*a,* it is required to increase the rigidity of the body 3*a* in the lateral directions. This can be attained by forming the connecting portion 3*b* from a leaf spring material of a metal high in rigidity or the like.

To make such a connecting portion, the connecting portion 3*b* and the key support member 5 may be formed into a unitary member by press-cutting and press-working, and then a through hole is formed in the rear end portion 3*an* of the body 3*a,* into which a free end of the connecting portion 3*b* of the unitary member is press fitted.

Alternatively, the connecting portion 3*b* may be formed of a material having a high rigidity to such a length that one end of the connecting portion 3*b* reaches the rear end portion 3*an* of the body 3*a* and the other end of the same reaches the key support 5, and then the connecting portion 3*b* is placed within a metal mold, followed by pouring molten resin into a space within the metal mold except for part of the connecting portion 3*b* whereby the body 3*a,* the extension 7, the key support 5, etc. are all formed into one piece. In this case as well, the connecting portion 3*b* and the key support 5 may be formed from a metal into a unitary member.

Although in the above described embodiment, each key unit is constructed such that a plurality of white keys 3 each have a key body 3*a* thereof integrally connected to a single white key support 5 via a connecting portion 3*b* thereof and a plurality of black keys 4 each have a key body 4*a* thereof integrally connected to a single black keys support 6 via a connecting portion 4*b,* this is not limitative, but the keyboard assembly may be constructed by juxtaposing a plurality of key units each formed of a single key having a key body thereof integrally connected to a single key support via a connecting portion thereof.

What is claimed is:

1. In a keyboard assembly including a plurality of white keys and black keys juxtaposed to each other, said white keys and said black keys each having a body disposed to be depressed, and a connecting portion, and key support means that supports said body, said body of each of said black keys having a bottom surface, said connecting portion connecting said body to said key support means in a fashion permitting said body to swing in directions of key depression and release while limiting lateral motions of said body, the improvement wherein said body of each of said white keys has an extension formed integrally therewith and laterally extending therefrom at a location under said body of a corresponding one of said black keys in a manner such that said extension overlaps with said bottom surface of said body of said corresponding one of said black keys, said extension being elongate longitudinally of each of said white keys.

2. A keyboard assembly according to claim 1, wherein said white keys are grouped into at least one group, said white keys of each of said at least one group being integrally connected to said key support means to form a single key unit.

3. A keyboard assembly according to claim 2, wherein said single key unit includes a C key, a D key and an E key.

4. A keyboard assembly according to claim 2, wherein said white keys of said each of said at least one group forming said single key unit include white keys located outward relative to at least one other white key forming said single key unit with respect to said single key unit, each of said white keys located outward having said extension located inward relative to said body of said each of said white keys located outward, with respect to said single key unit.

5. A keyboard assembly according to claim 1, wherein said extension and said connecting portion are formed integrally with each other.

6. In a keyboard assembly including a plurality of white keys and black keys juxtaposed to each other, said white keys and said black keys each having a body disposed to be depressed, and a connecting portion, and key support means that supports said body, said body of each of said black keys having a bottom surface, said connecting portion connecting said body to said key support means in a fashion permitting said body to swing in directions of key depression and release while limiting lateral motions of said body, the improvement wherein said body of each of said white keys has an extension formed integrally therewith and laterally extending therefrom at a location under said body of a corresponding one of said black keys in a manner such that said extension overlaps with said bottom surface of said body of said corresponding one of said black keys, said extension being elongate longitudinally of each of said white keys; and wherein said connecting portion of said each of said white keys is substantially equal in width in a direction of juxtaposition of said white keys and said black keys to a portion of said body of said each of said white keys formed with said extension, said white keys having respective ones of said body arranged in an order of pitch and integrally connected to said key support means via respective ones of said connecting portion.

7. In a keyboard assembly including a plurality of white keys and black keys juxtaposed to each other, said white keys and said black keys each having a body disposed to be depressed, and a connecting portion, and key support means that supports said body, said body of each of said black keys having a bottom surface, said connecting portion connecting said body to said key support means in a fashion permitting said body to swing in directions of key depression and release while limiting lateral motions of said body, the improvement wherein said body of each of said white keys has an extension formed integrally therewith and laterally extending therefrom at a location under said body of a corresponding one of said black keys in a manner such that said extension overlaps with said bottom surface of said body of said corresponding one of said black keys, said extension being elongate longitudinally of each of said white keys; and wherein said extension is disposed in a manner such that said bottom surface of said body of said corresponding one of said black keys becomes almost parallel with said extension when said corresponding one of said black keys is depressed.

8. In a keyboard assembly including a plurality of white keys and black keys juxtaposed to each other, said white keys and said black keys each having a body disposed to be depressed, and a connecting portion, and key support means that supports said body, said body of each of said black keys having a bottom surface, said connecting portion connecting said body to said key support means in a fashion permitting said body to swing in directions of key depression and release while limiting lateral motions of said body, the improvement wherein said body of each of said white keys has an extension formed integrally therewith and laterally extending therefrom at a location under said body of a corresponding one of said black keys in a manner such that said extension overlaps with said bottom surface of said body of said corresponding one of said black keys, said extension being elongate longitudinally of each of said white keys;

wherein said extension is disposed in a manner such that said bottom surface of said body of said corresponding one of said black keys becomes almost parallel with said extension when said corresponding one of said black keys is depressed; and wherein said extension is formed in an inclined fashion with respect to said body of said each of said white keys.

9. In a keyboard assembly including a plurality of white keys and black keys juxtaposed to each other, said white keys and said black keys each having a body disposed to be depressed, and a connecting portion, and key support means that supports said body, said body of each of said black keys having a bottom surface, said connecting portion connecting said body to said key support means in a fashion permitting said body to swing in directions of key depression and release while limiting lateral motions of said body, the improvement wherein said body of each of said white keys has an extension formed integrally therewith and laterally extending therefrom at a location under said body of a corresponding one of said black keys in a manner such that said extension overlaps with said bottom surface of said body of said corresponding one of said black keys, said extension being elongate longitudinally of each of said white keys;

wherein said connecting portion of said each of said white keys is substantially equal in width in a direction of juxtaposition of said white keys and said black keys to a portion of said body of said each of said white keys formed with said extension, said white keys having respective ones of said body arranged in an order of pitch and integrally connected to said key support means via respective ones of said connecting portion; and wherein a total width of said portion of said body of said each of said white keys formed with said extension in said direction of juxtaposition of said white keys and said black keys is substantially equal to a maximum width of said body of said each of said white keys in said direction.

* * * * *